US007301262B1

(12) United States Patent
Roberts et al.

(10) Patent No.: US 7,301,262 B1
(45) Date of Patent: Nov. 27, 2007

(54) METHOD AND AN APPARATUS FOR COOLING AN ARC LAMP

(75) Inventors: Roy D. Roberts, Hayward, CA (US); James P. Huynh, Fremont, CA (US)

(73) Assignee: Vaconics Lighting, Inc., Fremont, CA (US)

( * ) Notice: Subject to any disclaimer, the term of this patent is extended or adjusted under 35 U.S.C. 154(b) by 164 days.

(21) Appl. No.: 10/850,135

(22) Filed: May 19, 2004

(51) Int. Cl.
*H01J 1/02* (2006.01)
*H01J 7/24* (2006.01)
*H01J 61/52* (2006.01)
*H01K 1/58* (2006.01)

(52) U.S. Cl. ..... 313/46; 313/42

(58) Field of Classification Search ..... 313/42, 313/46

See application file for complete search history.

(56) References Cited

U.S. PATENT DOCUMENTS 3,628,846 A * 12/1971 Cortorillo ..... 445/26
4,195,745 A 4/1980 Roberts et al.
4,599,540 A * 7/1986 Roberts ..... 313/570
4,633,128 A 12/1986 Roberts et al.
4,658,179 A 4/1987 Roberts
4,702,716 A 10/1987 Roberts
4,724,352 A 2/1988 Schuda et al.
4,785,216 A 11/1988 Roberts et al.
4,823,043 A 4/1989 Roberts et al.
4,940,922 A 7/1990 Schuda et al.
5,299,279 A 3/1994 Roberts
5,399,931 A 3/1995 Roberts
5,418,420 A 5/1995 Roberts
5,498,937 A * 3/1996 Korber et al. ..... 315/248
5,561,338 A 10/1996 Roberts et al.
5,672,931 A 9/1997 Kiss et al.
5,721,465 A 2/1998 Roberts
6,034,467 A 3/2000 Roberts
6,087,774 A * 7/2000 Nakayama et al. ..... 313/607
6,181,053 B1 1/2001 Roberts
6,200,005 B1 3/2001 Roberts et al.
6,285,131 B1 9/2001 Kiss et al.
6,297,591 B1 10/2001 Roberts
6,316,867 B1 11/2001 Roberts et al.
6,351,058 B1 2/2002 Roberts
6,400,067 B1 * 6/2002 Manning et al. ..... 313/46
6,597,087 B2 7/2003 Roberts et al.
6,602,104 B1 8/2003 Roberts
2002/0154514 A1 * 10/2002 Yagi et al. ..... 362/510

* cited by examiner

*Primary Examiner*—Joseph Williams
*Assistant Examiner*—Bumsuk Won
(74) *Attorney, Agent, or Firm*—Blakely, Sokoloff, Taylor & Zafman LLP

(57) ABSTRACT

A method and an apparatus for cooling an arc lamp have been disclosed. In one embodiment, the arc lamp assembly includes an arc lamp, a first heat sink coupled to an anode of the arc lamp, and a thermally conductive ring surrounding a first part of the outer surface of a reflector body of the arc lamp to thermally couple the reflector body to the first heat sink. Other embodiments have been described and claimed.

22 Claims, 4 Drawing Sheets

METHOD AND AN APPARATUS FOR COOLING AN ARC LAMP

FIELD OF INVENTION

The present invention relates to arc lamps, and more particularly, to cooling an arc lamp.

BACKGROUND

In optical systems involving the generation and controlled radiation of long or continuous pulses of light, such as spectroscopy, or solar simulation, where high intensity, color correct illumination of sensitive working areas is required, such as in fiber optics illumination devices, it is advantageous to have a light source capable of producing the highest possible light flux density. Products utilized in such applications include short arc inert gas lamps, which may also be referred to as arc lamps. At least one short arc lamp includes a sealed chamber containing a gas pressurized to several atmospheres, and an opposed anode and cathode defining an arc gap. A window provides for the transmission of the generated light, and a reflector body may be positioned surrounding the arc gap.

During operation of an arc lamp, the anode and the cathode generate a significant amount of heat. The anode and the cathode are inside the sealed chamber of the arc lamp. As a result, the reflector body is also subjected to high heat during operation of the arc lamp. The operating power of the arc lamp may be limited by the reflector body temperatures. A lower temperature reflector body allows for a higher operating lamp power. Furthermore, the reflector body may crack, and the lamp will fail, when operated at high temperatures over a long period of time.

One existing technique to aid cooling of the reflector body is to directly couple a heat sink to the underside of the reflector body. However, the above technique is unsatisfactory because of the lack of adequate surface area in contact with the heat sink to dissipate heat from the reflector body to the heat sink.

Another existing technique is to add a copper band along the underside of the cathode heat sink to help cool off the reflector body. Alternatively, a thermal heat transfer pad is coupled to one end of the reflector body that is near the anode to facilitate heat dissipation from the reflector body. However, these techniques also suffer from the problem of inadequate surface area in contact with the heat sink to dissipate heat from the reflector body to the heat sink.

SUMMARY

A method and an apparatus for cooling an arc lamp are described. In one embodiment, the arc lamp assembly includes an arc lamp, a first heat sink coupled to an anode of the arc lamp, and a thermally conductive ring surrounding a first part of the outer surface of a reflector body of the arc lamp to thermally couple the reflector body to the first heat sink.

Other features of the present invention will be apparent from the accompanying drawings and from the detailed description that follows.

BRIEF DESCRIPTION OF THE DRAWINGS

The present invention will be understood more fully from the detailed description that follows and from the accompanying drawings, which however, should not be taken to limit the appended claims to the specific embodiments shown, but are for explanation and understanding only.

DETAILED DESCRIPTION

In the following description, numerous specific details are set forth. However, it is understood that embodiments of the invention may be practiced without these specific details. In other instances, well-known components, structures, and techniques have not been shown in detail in order not to obscure the understanding of this description.

Figure 1:
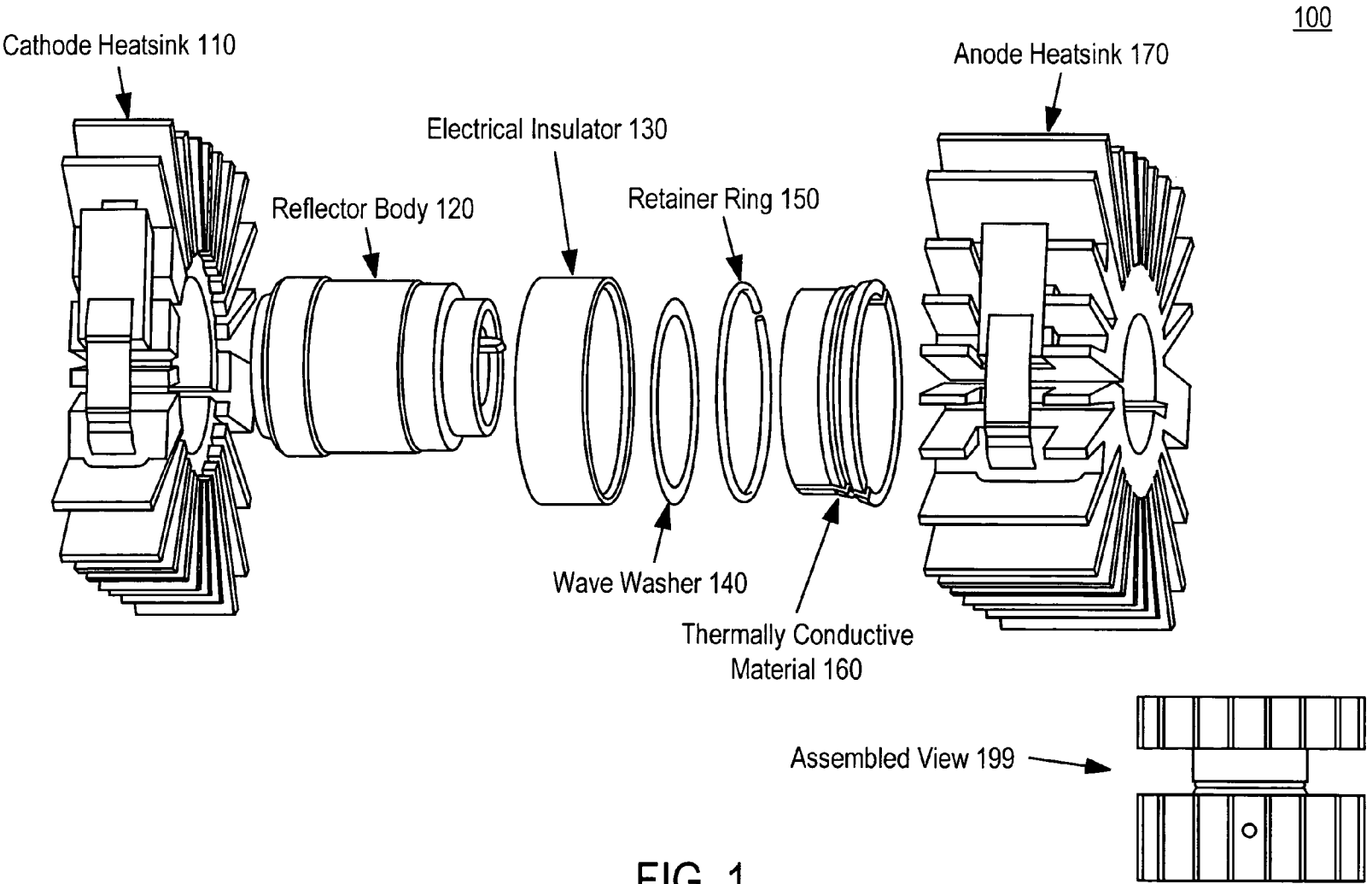
FIG. 1 shows one embodiment of an arc lamp assembly.

FIG. 1 illustrates one embodiment of an arc lamp assembly 100 with various components separated from each other for the purpose of illustration. An assembled view 199 of the various components is shown in the bottom right corner of FIG. 1. The arc lamp assembly 100 includes a cathode heat sink 110, an arc lamp 120, an electrical insulator ring 130, a wave washer spring 140, a retainer ring 150, a thermally conductive ring 160, and an anode heat sink 170. In addition to the above components, the arc lamp assembly 100 includes a cathode and an anode (not shown) mounted inside the arc lamp 120. The cathode is mounted near the end of the arc lamp 120 closer to the cathode heat sink 110 while the anode is mounted near the opposite end of the arc lamp 120.

The thermally conductive ring 160 may be pre-loaded to the arc lamp 120 using the wave washer spring 140. To hold the thermally conductive ring 160 in place to assure good contact between the thermally conductive ring 160 and the arc lamp 120, a retainer ring 150 may be coupled to the outer surface of thermally conductive ring 160. In one embodiment, the thermally conductive ring 160 is made of copper. Detail of the way heat is dissipated from the arc lamp 120 is discussed below with reference to FIG. 2.

To prevent arcing from the thermally conductive ring 160 to the cathode heat sink 110 of the arc lamp, the electrical insulator ring 130 is coupled to the reflector body 120 to surround the outer surface of the arc lamp 120 and in between the cathode heat sink 110 and the wave washer spring 140. In one embodiment, the electrical insulator ring 130 is made of glass silicon. Alternatively, the electrical insulator ring 130 is made of Teflon or an equivalent material that is electrically non-conductive and has a high thermal conductivity (e.g., up to 1800° C.) that is capable of sustaining operating temperature of the arc lamp.

Figure 2:
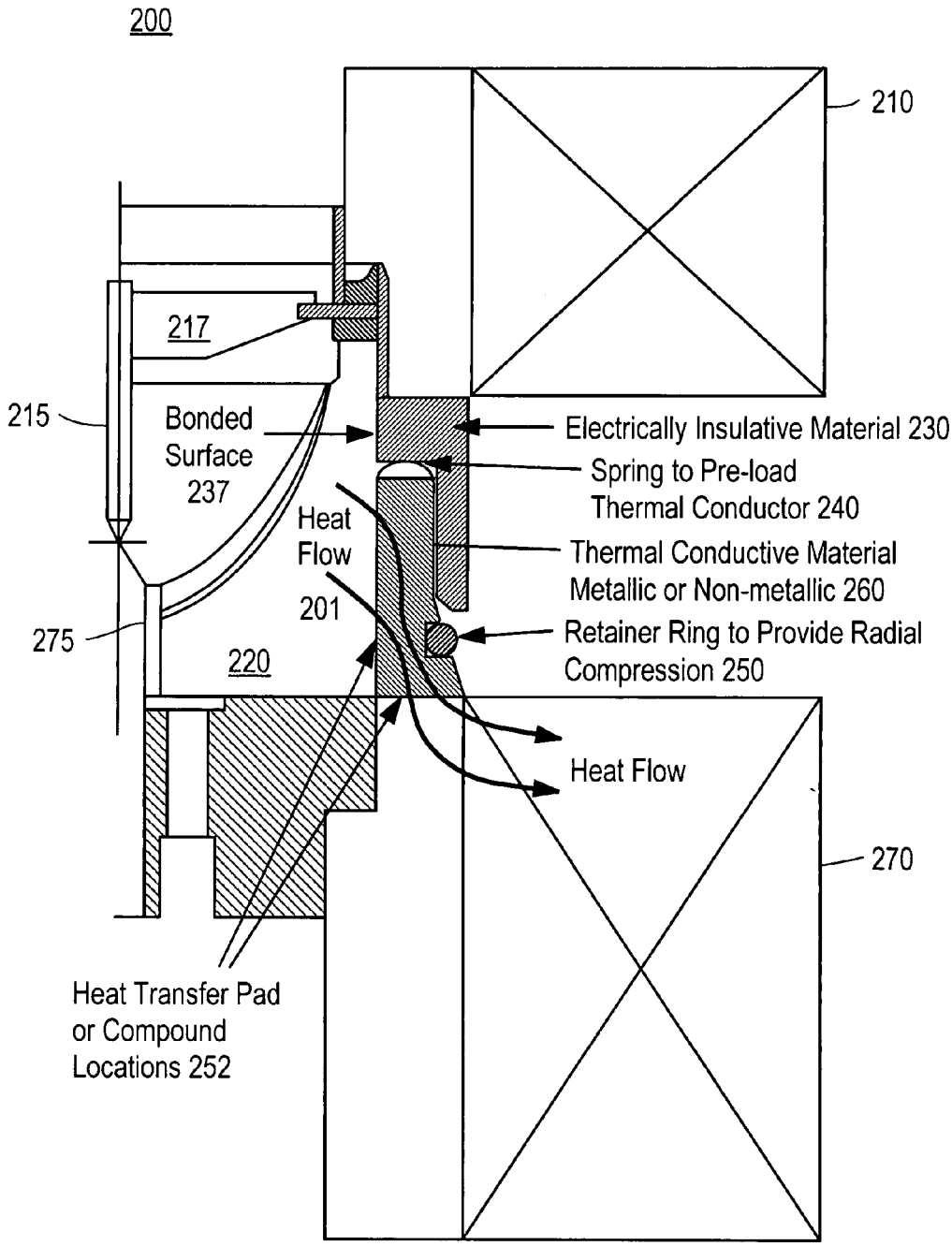
FIG. 2 shows a cross-section view of an embodiment of an arc lamp assembly.

FIG. 2 shows a cross-sectional view of one embodiment of an arc lamp assembly 200. For the purpose of illustration, only the right half of the cross-section is shown, which provides sufficient details to one of ordinary skill in the art to practice the embodiment of the present invention. The arc lamp assembly 200 includes a cathode heat sink 210, a cathode 215, an anode heat sink 270, an anode 275, a reflector body 220, an electrically insulator ring 230, a spring 240, a thermally conductive ring 260, and a retainer ring 250.

The anode 275 is mounted at one end of the reflector body 220 and the cathode 215 is mounted by a strut 217 near the opposite end of the reflector body 220. The outer surface of the reflector body 220 is surrounded by the thermally conductive ring 260. In one embodiment, the thermally conductive ring 260 is pre-loaded by the spring 240. Furthermore, to ensure good contact between the thermally conductive ring 260 and the outer surface of the reflector body 220, the retainer ring 250 is coupled to the outer surface of the thermally conductive ring 260 to provide radial compression onto the thermally conductive ring 260. In one embodiment, the thermally conductive ring 260 is made of metallic material, such as copper. Alternatively, the thermally conductive ring 260 may be made of non-metallic material, such as aluminum nitride.

During operation of the arc lamp assembly 200, the reflector body 220 is subjected to high heat generated by the anode 275 and the cathode 215. To cool off the reflector body 220, the thermally conductive ring 260 allows a heat flow 201 to travel from the reflector body 220 to the anode heat sink 270, which dissipates the heat. Since the thermally conductive ring 260 provides a large surface area in contact with the reflector body 220, the rate of heat flow through the thermally conductive ring 260 may be increased.

To further facilitate the heat flow 201, one or more heat transfer pads or compounds 252 may be added at the locations between the thermally conductive ring 260 and the reflector body 220 or between the thermally conductive ring 260 and the anode heat sink 270.

To prevent arcing from the thermally conductive ring 260 to the metal ring of the arc lamp, the electrical insulator ring 230 may be coupled between the spring 240 and the cathode heat sink 210. In one embodiment, the electrical insulator ring 230 is bonded to the outer surface 237 of the reflector body 220.

Figure 3:
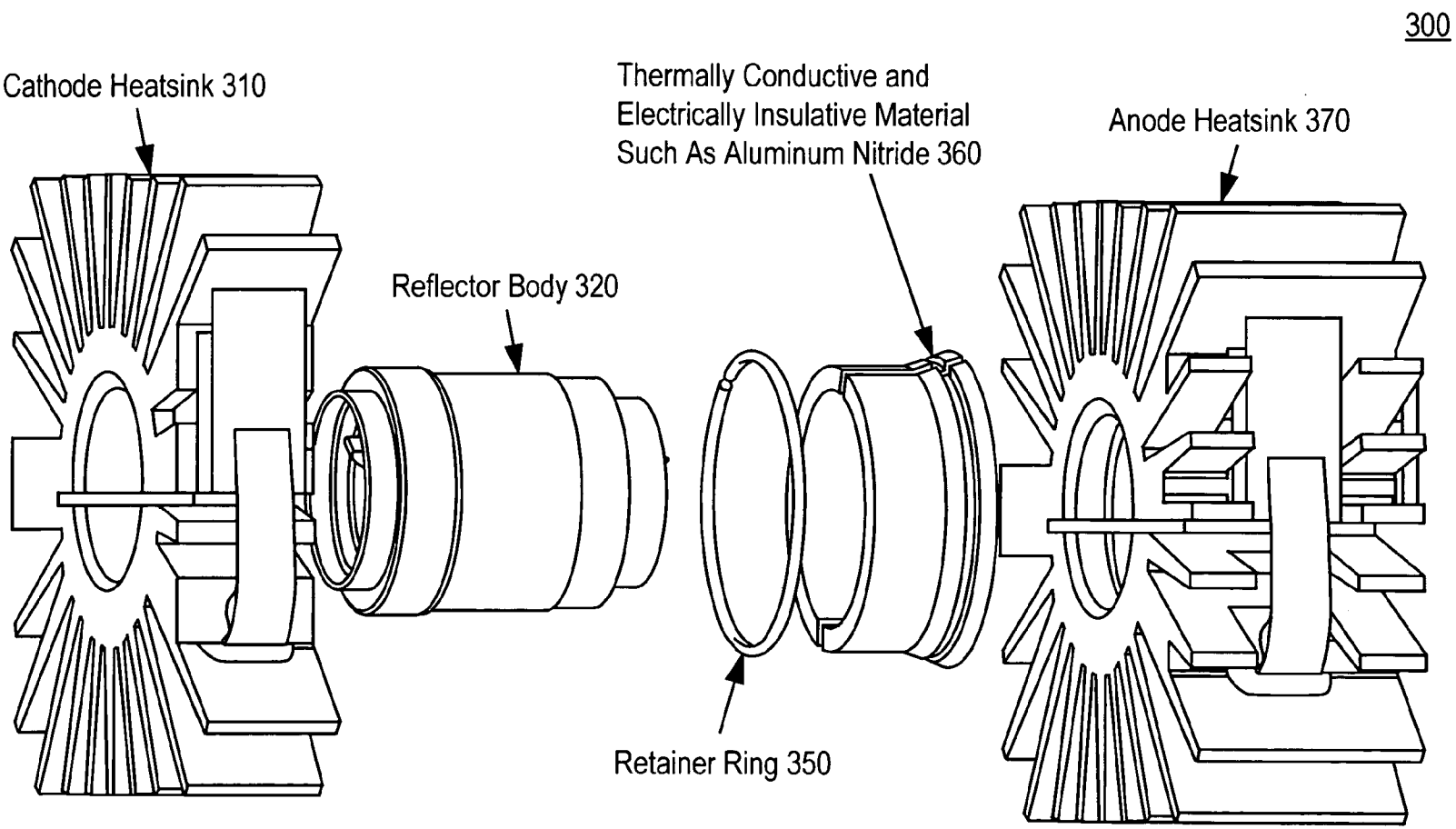
FIG. 3 shows an alternate embodiment of an arc lamp assembly.

FIG. 3 illustrates an alternate embodiment of an arc lamp. Various components of the arc lamp assembly 300 in FIG. 3 are separated from each other for the purpose of illustration. The arc lamp assembly 300 includes a cathode heat sink 310, an arc lamp 320, a retainer ring 350, a thermally conductive and electrically insulative ring 360, and an anode heat sink 370. The arc lamp assembly 300 further includes an anode and a cathode (not shown) mounted inside the arc lamp 320. When assembled, the thermally conductive and electrically insulative ring 360 is coupled to the outer surface of the arc lamp 320, surrounding the arc lamp 320. To improve contact between the arc lamp 320 and the thermally conductive and electrically insulative ring 360, the retainer ring 350 may be coupled to the outer surface of the thermally conductive and electrically insulative ring 360 to provide radial compression onto the thermally conductive and electrically insulative ring 360. In one embodiment, the thermally conductive and electrically insulative ring 360 is made of aluminum nitride. More detail on the operation of the arc lamp assembly 300 is discussed below.

Figure 4:
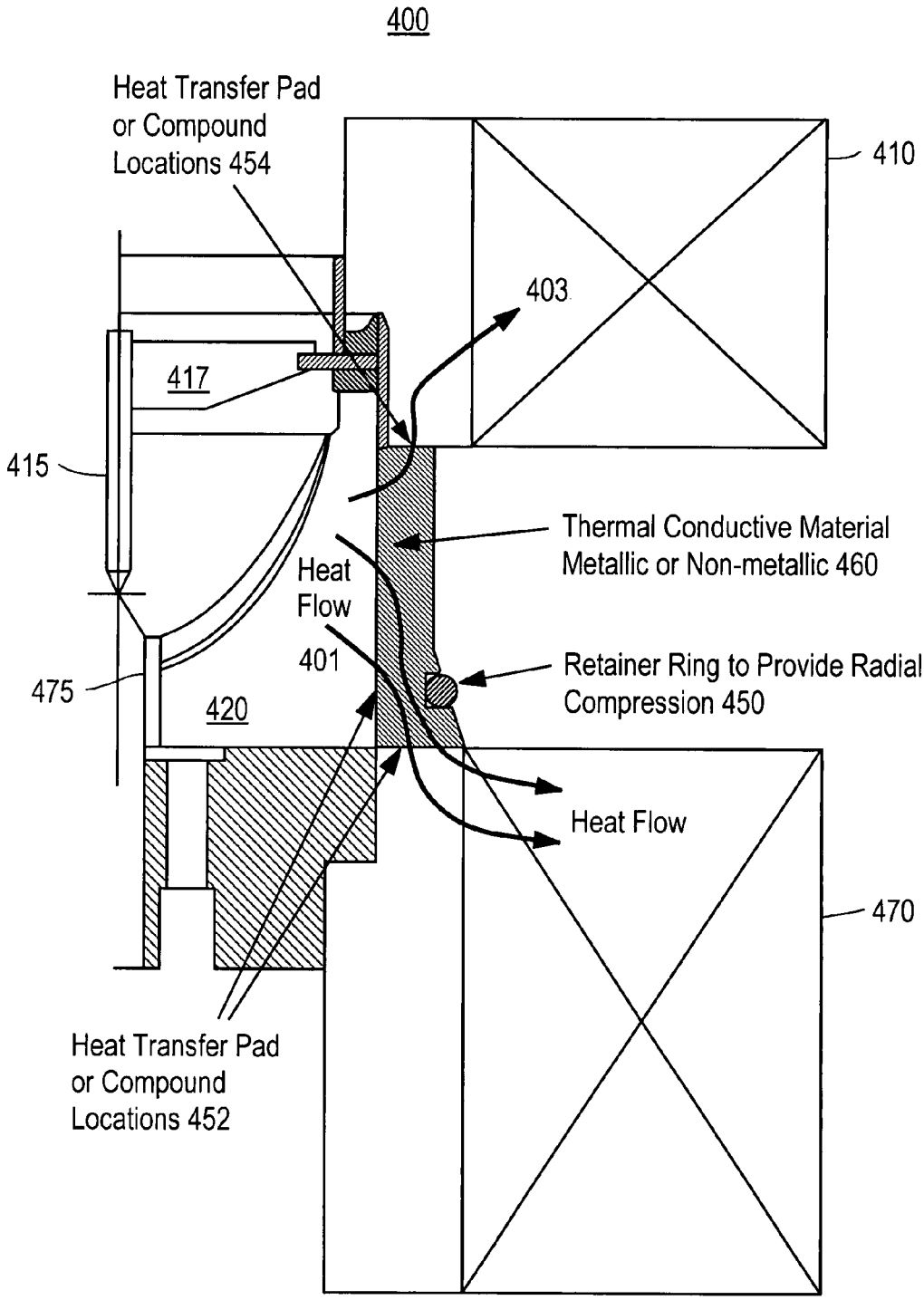
FIG. 4 shows a cross-section view of one embodiment of an arc lamp assembly.

FIG. 4 shows a cross-sectional view of one embodiment of an arc lamp assembly. For the purpose of illustration, only the right half of the cross-section is shown, which provides sufficient details to one of ordinary skill in the art to practice the embodiment of the present invention. The arc lamp assembly 400 includes a cathode heat sink 410, a cathode 415, an anode heat sink 470, an anode 475, a reflector body 420, a thermally conductive and electrically insulative ring 460, and a retainer ring 450. The thermally conductive and electrically insulative ring 460 may be made of aluminum nitride.

The inner surface of the thermally conductive and electrically insulative ring 460 is coupled to the outer surface of the reflector body 420 to surround the reflector body 420. A first end of the thermally conductive and electrically insulative ring 460 is coupled to the cathode heat sink 410 and the second end of the thermally conductive and electrically insulative ring 460 is coupled to the anode heat sink 470. By surrounding the outer surface of the reflector body 420, the ring 460 provides more surface area for heat transfer to improve cooling of the reflector body 420. Heat may flow from the reflector body 420 through the ring 460 to either the cathode heat sink 410 and/or the anode heat sink 470 as indicated by the arrows 403 and 401, respectively.

In one embodiment, the retainer ring 450 is coupled to the outer surface of the thermally conductive and electrically insulative ring 460 to provide radial compression onto the thermally conductive and electrically insulative ring 460 in order to hold the thermally conductive and electrically insulative ring 460 in position and to improve the contact between the thermally conductive and electrically insulative ring 460 and the reflector body 420. Furthermore, one or more heat transfer pads or compounds may be coupled to the surfaces of the thermally conductive and electrically insulative ring 460 that are adjacent to the reflector body 420 or one of the heat sinks 410 and 470. Some exemplary positions at which the heat transfer pads or compounds may be coupled to are indicated by the reference numerals 452 and 454 in FIG. 4.

By increasing the surface area of the thermally conductive and electrically insulative ring 460, via which the reflector body 420 may dissipate heat to the heat sinks 410 and/or 470, the reflector body 420 may be cooled faster. With a faster cooling rate, the reflector body 420 may operate at higher temperatures, and hence, the power of the arc lamp 400 may be increased without risking increasing the likelihood of cracking the reflector body 420. In an exemplary embodiment, the power of the arc lamp assembly 400 may be increased by approximately 30%, such as, for example, from approximately 300 watts to about 400 watts.

The foregoing discussion merely describes some exemplary embodiments of the present invention. One skilled in the art will readily recognize from such discussion, the accompanying drawings and the claims that various modifications can be made without departing from the spirit and scope of the invention.

What is claimed is:

1. An arc lamp assembly comprising:

an arc lamp having a ceramic body, an anode, and a cathode, the ceramic body having an inner reflector surface and an outer surface;

a first heat sink coupled to the anode of the arc lamp;

a thermally conductive non-ceramic ring, distinct from the ceramic body of the arc lamp, surrounding a first part of the outer surface of the ceramic body of the arc lamp to thermally couple the ceramic body to the first heat sink; and a retainer ring coupled to the thermally conductive ring to hold the thermally conductive ring.

2. The arc lamp assembly of claim 1, further comprising:

a second heat sink coupled to the cathode of the arc lamp.

3. The arc lamp assembly of claim 2, further comprising a washer spring, wherein the thermally conductive ring has a first end, a second end, and an inner wall between the first end and the second end, the first end coupled to the washer spring, the second end coupled to the first heat sink, and the inner wall coupled to the first part of the outer surface of the body to allow heat from the reflector body to flow through the inner wall and the second end to the first heat sink.

4. The arc lamp assembly of claim 3, further comprising an electrically insulative ring coupled between the washer spring and the second heat sink, having an inner surface and an outer surface.

5. The arc lamp assembly of claim 4, wherein the inner surface of the electrically insulative ring is bonded to a second part of the outer surface of the body.

6. The arc lamp assembly of claim 5, wherein the electrically insulative ring comprises glass silicon.

7. The arc lamp assembly of claim 4, wherein the thermally conductive ring comprises copper.

8. The arc lamp assembly of claim 2, further comprising a heat transfer pad coupled between the thermally conductive ring to the second heat sink.

9. The arc lamp assembly of claim 8, wherein the thermally conductive ring is electrically insulative.

10. The arc lamp assembly of claim 9, wherein the thermally conductive ring comprises aluminum nitride.

11. The arc lamp assembly of claim 1, wherein the thermally conductive ring can sustain up to 1800° C.

12. A method to cool an arc lamp, the method comprising:

coupling an outer surface of a ceramic body of the arc lamp to a first heat sink using a thermally conductive non-ceramic ring to enable heat to flow from the ceramic body, through the thermally conductive non-ceramic ring, to the first heat sink, wherein the ceramic body is distinct from the thermally conductive non-ceramic ring, the ceramic body comprises an inner reflector surface and the outer surface, the inner reflector surface defining a cavity housing an anode and a cathode of the arc lamp, and the first heat sink is coupled to the anode; and holding the thermally conductive non-ceramic ring in position using a retainer ring.

13. The method of claim 12, further comprising coupling a first set of one or more heat transfer pads between the body and the thermally conductive ring.

14. The method of claim 13, further comprising coupling a second set of one or more heat transfer pads between the first heat sink and the thermally conductive ring.

15. The method of claim 14, wherein the thermally conductive ring is thermally coupled to a second heat sink, wherein the second heat sink is coupled to the cathode of the arc lamp.

16. The method of claim 15, further comprising interfacing the thermally conductive ring to the second heat sink using a heat transfer pad.

17. The method of claim 15, wherein the thermally conductive ring is electrically insulative.

18. The method of claim 15, wherein the thermally conductive ring comprises aluminum nitride.

19. The method of claim 12, further comprising preloading the thermally conductive ring using a washer spring.

20. The method of claim 19, further comprising coupling an electrically insulative ring between the washer spring and a second heat sink, wherein the second heat sink is coupled to the cathode of the arc lamp, the electrically insulative ring having an inner surface and an outer surface.

21. The method of claim 20, wherein coupling the electrically insulative ring includes bonding the inner surface of the electrically insulative ring to the outer surface of the body.

22. The method of claim 12, wherein the thermally conductive ring can sustain up to 1800° C.

* * * * *